United States Patent [19]

Yoshihara et al.

[11] 4,370,210

[45] Jan. 25, 1983

[54] METHOD AND APPARATUS FOR CONTINUOUSLY FORMING COLOR DISPLAY LAYER ON STAINLESS STEEL STRIP

[75] Inventors: Tsuyoshi Yoshihara, Sanjo; Nobuaki Ohashi, Niiza, both of Japan

[73] Assignee: Nippon Kinzoku Co., Ltd., Tokyo, Japan

[21] Appl. No.: 242,165

[22] Filed: Mar. 10, 1981

[51] Int. Cl.[3] ..... C23F 5/02

[52] U.S. Cl. ..... 204/140; 204/1 T; 204/211; 204/231; 148/6.14 R; 148/6.2; 148/6.21; 427/10; 118/665; 118/672; 118/712

[58] Field of Search ..... 148/6.21, 6.14 R, 6.15 R, 148/6.2; 427/10; 204/1 T, 231, 211, 140; 118/672, 665, 712

[56] References Cited

U.S. PATENT DOCUMENTS

| | | | |
|---|---|---|---|
| 3,207,125 | 9/1965 | Strandberg | 118/665 |
| 3,804,730 | 4/1974 | Evans et al. | 204/56 R |
| 3,839,096 | 10/1974 | Skedgell et al. | 148/6.2 |
| 4,026,737 | 5/1977 | Takahari | 148/6.21 |
| 4,269,633 | 5/1981 | Takeuchi et al. | 148/6.21 |

FOREIGN PATENT DOCUMENTS

| | | |
|---|---|---|
| 1122172 | 7/1968 | United Kingdom . |
| 1122173 | 7/1968 | United Kingdom . |

*Primary Examiner*—John D. Smith
*Assistant Examiner*—Richard Bueker
*Attorney, Agent, or Firm*—Oblon, Fisher, Spivak, McClelland & Maier

[57] ABSTRACT

In continuously forming color display layer on the surface of the stainless steel strip, potential difference between the strip immersed in the oxidizing solution and a reference electrode is utilized for controlling the thickness, or color tone, of the color display layer, namely, the relationship between the thickness of the color display layer and the potential difference mentioned above is measured first, followed by continuously immersing a strip of the same kind in the oxidizing solution for forming a color display layer on the surface of the strip. The difference in thickness between the actually formed color display layer and a desired color display layer is converted into the difference in potential difference based on the above-noted relationship and the immersion time of the strip in the oxidizing solution is controlled on the basis of said difference in potential difference. The section for measuring the natural potential in the process of forming the color display layer is electrically separated from the power source used for hardening the color display layer. Further, an electric circuit is not formed and a potential difference is generated between the tank housing the oxidizing solution and the stainless steel strip.

5 Claims, 6 Drawing Figures

METHOD AND APPARATUS FOR CONTINUOUSLY FORMING COLOR DISPLAY LAYER ON STAINLESS STEEL STRIP

This invention relates to a method and apparatus for continuously forming a color display layer on the surface of stainless steel.

A color display layer (or oxide layer) formed on the surface of stainless steel exhibits a metallic luster of various color tones and, thus produces a highly decorative effect. Techniques of forming such a color display layer are disclosed in, for example, British Pat. Specifications Nos. 1,122,172 and 1,122,173. In any of the prior arts exemplified above, stainless steel, having the surface sufficiently polished in advance, is immersed in a mixture of sulfuric acid and chromic acid so as to form a color display layer on the surface of the stainless steel, followed by subjecting the color display layer to a hardening treatment by electrolysis in a mixture of phosphoric acid and chromic acid. It should be noted that the resultant color display layer is markedly influenced by the composition and temperature of the oxidizing liquor, i.e., acid mixture, as well as by the surface conditions of the stainless steel, rendering it absolutely necessary to control accurately the oxidizing solution and stainless steel for obtaining a color display layer of a desired color tone.

In order to control the color tone of the color display layer, it is proposed to monitor the potential difference between the stainless steel immersed in the oxidizing solution and a reference electrode, in view of the fact that the potential difference mentioned, changes with time in accordance with growth in the thickness of the color display layer. This control method is certainly effective where a color display layer is formed on a stainless steel plate on a batch system. But, where a stainless steel strip is continuously immersed in an oxidizing solution, it is impossible to utilize changes which occur with time in potential difference between the reference electrode and the strip immersed in the oxidizing solution because the potential difference mentioned is maintained substantially constant. It should also be noted that the color tone of the color display layer is remarkably influenced by the material and surface condition of stainless steel and the composition and temperature of the oxidizing solution even if the potential difference in question is maintained constant. It follows that the color tone of the color display layer formed in one case is not necessarily equal to that of the color display layer formed in another case. Under the circumstances, it was customary to control the immersion time of a stainless steel strip in an oxidizing solution based mainly on experiences where a color display layer of a desired color tone is continuously formed on the strip, leading to nonuniformity in color tone of the color display layers.

Further, it was customary to employ a batch system in which the color display layer formation and the hardening treatment of the color display layer are carried out independently, with the result that it was difficult to obtain stainless steel strips bearing color display layers of uniform color tone. For overcoming the difficulty mentioned, it is thought effective to pass a long stainless steel strip continuously through an oxidizing solution for forming a color display layer, i.e., oxide film, on the strip and through an electrolytic solution for hardening the color display layer. In the conventional continuous treatment, however, part of the current for the electrolytic solution tends to flow into the oxidizing solution through the stainless steel strip under treatment, rendering it difficult to measure the natural potential of the strip and, thus, to control the thickness of the oxide film. In other words, it is absolutely necessary to solve the above-noted problem for bringing a continuous treatment into practical uses.

One object of this invention is to provide a method of continuously forming a color display layer on the surface of a stainless steel strip by immersing the strip in an oxidizing solution, in which the potential difference between the strip immersed in the oxidizing solution and a reference electrode is utilized for controlling the immersion time of the strip in the solution.

According to this invention, there is provided a method of continuously forming a color display layer on the surface of a stainless steel strip by immersing the strip in an oxidizing solution, comprising:

tentatively immersing a stainless steel strip continuously in an oxidizing solution for forming a color display layer on the surface of the strip, thereby measuring first the relationship between the thickness of color tone of the color display layer and the potential difference between the strip immersed in the oxidizing solution and reference electrode; and continuously immersing the same kind of stainless steel strip in said oxidizing solution for forming a color display layer on the surface of said strip, the difference in thickness between the actually formed color display layer and a desired color display layer being converted to the difference in potential difference on the basis of the relationship measured first, and the immersion time of the strip in the oxidizing solution being controlled on the basis of said difference in potential difference.

According to this invention, there is also provided an apparatus for continuously forming a color display layer on the surface of stainless steel strip, which comprises:

a tank containing an oxidizing solution for forming a color display layer on the surface of the strip;

a means for measuring potential difference between the strip and a reference electrode immersed in the oxidizing solution;

a means for measuring the relationship between the thickness of the color display layer and said potential difference;

a means for controlling the immersion time on the basis of said relationship;

a means for rinsing the color display layer;

a tank containing a hardening solution; and a means for conducting electric current between the strip and an electrode immersed in the hardening solution, wherein the stainless steel strip included in the circuit for measuring the potential difference is separated from the current conducting means and an electric circuit is not formed between the strip and the reference electrode immersed in the oxidizing solution so as to generate a potential difference therebetween.

This invention can be more fully understood from the following detailed description when taken in conjunction with the accompanying drawings, in which.

Before forming a color display layer, the surface of a stainless steel strip is polished by, for example, buffing or chemical polishing. In this step, the surface of the strip may be patterned by etching or embossing. The surface polishing should be carried out thoroughly because uneven polishing causes unevenness in the color tone of the formed color display layer. After the surface polish, the stainless steel strip should be cleaned and water-washed so as to remove completely the oil and fat as well as dust from the strip. For the cleaning, it is possible to employ ordinary methods such as immersion in an alkaline solution and electrolysis.

Figure 1:
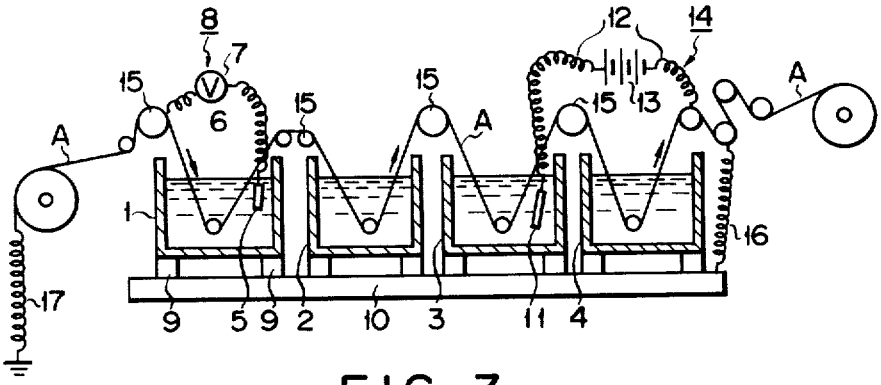
FIG. 1 is a schematic cross sectional view showing an apparatus used for continuously forming a color display layer on the surface of a stainless steel strip according to the method of this invention.

After completion of the pretreatment, a stainless steel strip A is passed successively through an oxidizing solution tank 1, a water tank 2, a hardening solution tank 3 and a water tank 4 as shown in FIG. 1. An oxide film, i.e., color display layer, is formed on the surface of the strip A within the tank 1 and, after water-washed within the tank 2, hardened within the tank 3 by means of electrolysis. Finally, the strip A bearing the hardened color display layer is washed with water within the tank 4 and rolled up. In this fashion, a color display layer is formed continuously on the surface of the strip A.

A mixture of sulfuric acid and chromic acid, or bichromate is used as the oxidizing solution. In order to form a uniform oxide film on the surface of the strip A in a short time, the mixture should generally consist of 450 to 800 g/l of sulfuric acid and 50 to 350 g/l of chromic acid. Desirably, the mixture should be kept at 70° to 120° C. The thickness of the oxide film is controlled on the basis of the natural potential of the stainless steel strip A. Specifically, a reference electrode 5 formed of, for example, platinum is immersed in the oxidizing solution in a manner to face the strip A. Further, the reference electrode 5 and the strip A are connected to a potentiometer 7 via lead wires 6 so as to form a circuit 8 for measuring the potential difference between the electrode 5 and the strip A. Naturally, the oxide film thickness is controlled on the basis of the indication of the potentiometer 7. In general, the strip A is immersed in the oxidizing solution for about 10 minutes, though the immersion time depends on the desired color of the color display layer as well as on the temperature and composition of the oxidizing solution containing chromic acid or potassium bichromate. It should be noted that the oxidizing solution tank 1 is disposed on a substrate 10 with an insulating member 9 such as rubber interposed therebetween so as to electrically insulate the strip A from the tank 1. Otherwise, an electric circuit is formed between the strip A and the tank 1, with the result that the strip A and the tank 1 are allowed to bear the same potential. In this case, it is of course impossible to form an oxide film on the surface of the strip A. The material of the tank 1 is not particularly restricted, though a metal nobler than the stainless steel strip A may be used for forming the tank 1.

Figure 2:
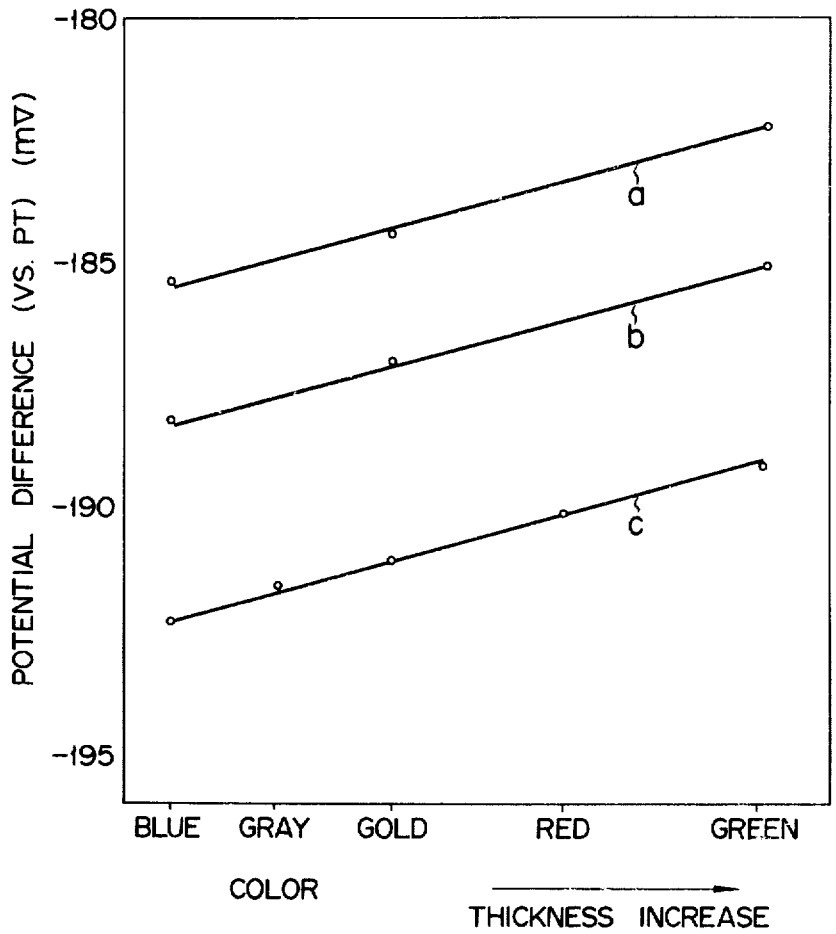
FIG. 2 is a graph showing the relationship between the thickness (or color tone) of a color display layer and the potential difference between the stainless steel band immersed in an oxidizing solution and a reference electrode.

The immersion time of strip A in the liquor is controlled on the basis of the potential difference between strip A and a reference electrode 5 formed of, for example, platinum and immersed in solution. To be more specific, the relationship between the potential difference mentioned above and the thickness or color tone of the color display layer formed on the stainless steel strip is measured first by continuously immersing the strip in the solution. Lines a, b, c shown in FIG. 2 represent the relationship mentioned above. It should be noted that the same potential difference does not necessarily bring about the same thickness of the color display layer as seen from FIG. 2. This is because subtle influences are given to the process of forming the color display layer by the material and surface condition of the stainless steel strip as well as by the composition of the oxidizing solution. It should also be noted, however, that the graphs of the color display layer thickness relative to the potential difference are inclined at almost the same angle. In other words, the difference in potential difference between two optional color tones of the color display layer is constant. For example, the difference between blue and green is 3.2 mV and the difference between blue and grey is 0.5 mV. The reason for this phenomenon is unclear.

After preparation of a graph as shown in FIG. 2, the stainless steel strip A is continuously immersed in the oxidizing solution contained in the tank 1 so as to form a color display layer on the surface of the strip A. In this step, the immersion time of the strip in the solution is set optionally. Potential difference between the reference electrode 5 and strip A during the operation is measured together with the thickness or color tone of the formed color display layer. Then, difference in potential difference between the color tone of the color display layer and a desired color tone is determined based on the graph of FIG. 2 so as to control the immersion time of strip A in a manner to form a color display layer of the desired color tone. Suppose the color display layer actually formed is grey and it is desired to form a blue color display layer. In this case, the difference in potential difference is 0.5 mV as seen from FIG. 2. Thus, the immersion time is shortened such that the potential difference between the reference electrode 3 and strip A is made 0.5 mV smaller than the initially measured value. Where it is intended to form a golden color display layer, the immersion time is prolonged such that the potential difference mentioned is made larger than the initially measured value by 0.6 mV (difference between gold and grey is 0.6 mV). After the desired color tone has been obtained, the stainless steel strip is continuously passed through the oxidizing solution at a constant potential.

It is possible to control manually, the immersion time, or running speed, of the stainless steel strip. Alternatively, the immersion time can be controlled automatically. In this case, the difference in potential difference is automatically detected and the detected signal is supplied to the driving means of the stainless steel strip so as to control the immersion time of the strip in the oxidizing solution.

The stainless steel strip A having an oxide film formed thereon is washed with water within the water tank 2 and, then, immersed in the hardening solution contained in the tank 3. The oxide film is hardened within the hardening solution by means of electrolysis.

Specifically, a mixture of phosphoric acid and chromic acid, which is used as the hardening solution, is electrolyzed so as to allow the metal chromium atoms or chromium hydroxide liberated by the electrolysis to fill the pores of the oxide film and, thus, to harden the oxide film. As shown in FIG. 1 a current conducting means 14 utilized in the electrolysis comprises an anode 11 formed of, for example, lead, which is immersed in the hardening solution, the strip A acting as a cathode, and a DC power source 13 connected between the anode and cathode via lead wires 12. In general, the electrolysis is performed for about 10 minutes under a current density of 0.2 to 0.3 $A/dm^2$.

It is important to note that the stainless steel strip A included in the circuit 8 for measuring the natural potential of the strip A is separated from the current conducting means 14. In other words, the circuit 8 and the current conducting means 14 are separated from each other. It follows that the current flowing through the electrolytic system scarcely flows into the circuit 8, with the result that the indication of the potentiometer 7 is stabilized and, thus, the thickness of the oxide film formed on the strip A can be controlled without difficulty. Incidentally, the strip A is guided by guide rollers 15. Further, both the strip A and the substrate 10 are connected to the ground via lead wires 16 and 17.

Figure 3:
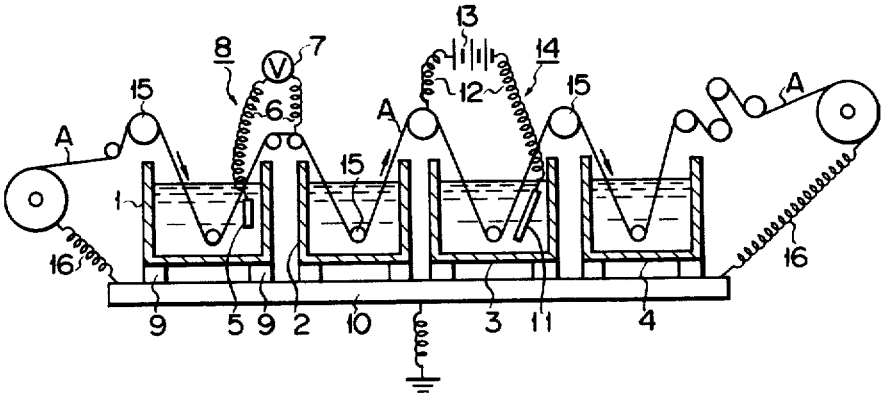
FIG. 3 is a schematic cross sectional view showing an apparatus according to another embodiment of this invention.

FIG. 3 shows an apparatus according to another embodiment of this invention. The embodiment of FIG. 3 differs from the embodiment of FIG. 1 in the connection points of the stainless steel strip A to the circuit 8 and to the current conducting means 14, though the strip A included in the circuit 8 is electrically separated from the current conducting means 14 in FIG. 3 as in FIG. 1. To be brief, it is possible to modify the embodiment of FIG. 1 as far as the circuit 8 for measuring the natural potential of the strip A is separated from the electrolytic system.

The stainless steel which can be treated by the method of this invention includes, for example, austenite series stainless steel such as SUS 301, 302, 304, 316, 321 and ferrite series stainless steel such as SUS 405, 430, 434.

EXAMPLE 1

A stainless steel strip was actually treated by the method of this invention. Specifically, a stainless steel strip of SUS 304 with a polished surface, was degreased and then passed through an oxidizing liquor maintained at 89° C. and consisting of 540 g/l of sulfuric acid and 240 g/l of chromic acid at a speed of 70 cm/min. Since the effective length of the tank containing the solution was 3,500 mm, the immersion time of the strip in the solution was 5.0 minutes. A grey color display layer was formed on the surface of the strip. Further, the potential difference between the reference electrode and the stainless steel strip was found to be −191.6 mV. Then, the potential difference mentioned was set at 192.3 mV, which is lower by 0.7 mV than the initial value, by increasing the strip running speed to 82 cm/min so as to form a desired blue color display layer. Incidentally, differnce in potential difference between grey and blue is 0.7 mV. Thereafter, the strip running speed was controlled so as to maintain the potential difference at −192.3 mV. The resultant stainless steel strip had a color display layer of uniform color tone.

EXAMPLE 2

Stainless steel strips were continuously treated by using an apparatus as shown in FIG. 1. A mixture of 295 g/l of chromic acid and 502 g/l of sulfuric acid, which was maintained at 85° C., was used as the oxidizing solution. Also, a mixture of 250 g/l chromic acid and 2.5 g/l of phosphoric acid was used as the hardening solution and electrolysis was carried out under a current density of 0.3 $A/dm^2$. Further, the immersion time of the strip in the hardening solution was 10 minutes.

The running speed of one of the stainless steel strips through the oxidizing solution was controlled in a manner to form a blue color display layer on the surface of said strip. Specifically, the running speed mentioned was controlled in a manner to allow potentiometer 8 to indicate −185.0 to −185.3 mV. The treatment was continued for about 4 hours, with the result that the entire surface of the strip was covered with a blue color display layer.

In order to form a golden color display layer on the surface of the strip, the running speed in question was controlled in another treatment in a manner to allow the potentiometer to indicate −184.4 to −184.7 mV. The treatment was continued for about 4 hours, with the result that the entire surface of the strip was covered with a golden color display layer.

In still another treatment, it was intended to form a green color display layer. To this end, the running speed of the strip through the oxidizing solution was controlled in a manner to allow the potentiometer to indicate −182.4 to −182.7 mV. The treatment was continued for about 4 hours, with the result that the entire surface of the strip was covered with a green color display layer.

Further, the color tone of the golden color display layer formed on the stainless steel strip was measured at an interval of 2.5 m over a strip length of 350 m, and Hunter's formula was applied to the color tones thus measured for determining a color difference $\Delta E$, with the result that the standard deviation $\sigma$ of $\Delta E$ was 1.01.

Control 1

Stainless steel strips were continuously treated as in Example 2 except that the potentiometer 8 was removed from the treating apparatus.

In one of the operations, the running speed of the strip through the oxidizing solution was set in advance in a manner to form a blue color display layer on the surface of the strip. The treatment was continued for 4 hours, maintaining constant the strip running speed mentioned above. The color display layer formed in the late stage of the treatment was found to be somewhat reddish. The change in composition of the oxidizing solution caused by evaporation, etc. is thought to have brought about the color change of the color display layer.

In another operation, the strip running speed was set in a manner to form a golden color display layer on the strip and the treatment was continued for 4 hours, maintaining constant the strip running speed. As in Example 2, a color difference $\Delta E$ of the resultant color display layer was determined by Hunter's formula. The standard deviation $\delta$ was found to be as large as 1.83 in contrast to 1.01 for Example 2. This substantiates that the control of the potential difference between the stainless steel strip and the reference electrode immersed in the oxidizing solution is very important for forming a color display layer of uniform color tone.

Control 2

Stainless steel strips were tested as in Example 2 except that the oxidizing solution tank 1 was directly connected electrically to the ground. Naturally, an electric circuit was formed between the tank 1 and the strip. In this case, a color display layer was not formed at all on the surface of the treated strip.

An additional treatment was conducted as in Example 2 except that an apparatus as shown in FIG. 3 was used in place of the apparatus shown in FIG. 1. In this case, however, the oxidizing solution tank 1 was directly disposed on the substrate 10; namely, the insulating member 9 disposed between the tank 1 and the substrate 10 was removed in this experiment. In this case, however, it was impossible to control the color display layer on the basis of the potential difference, though the color display layer was formed display layer was not formed at on the surface of the treated stainless steel strip.

Control 3

Figure 4:
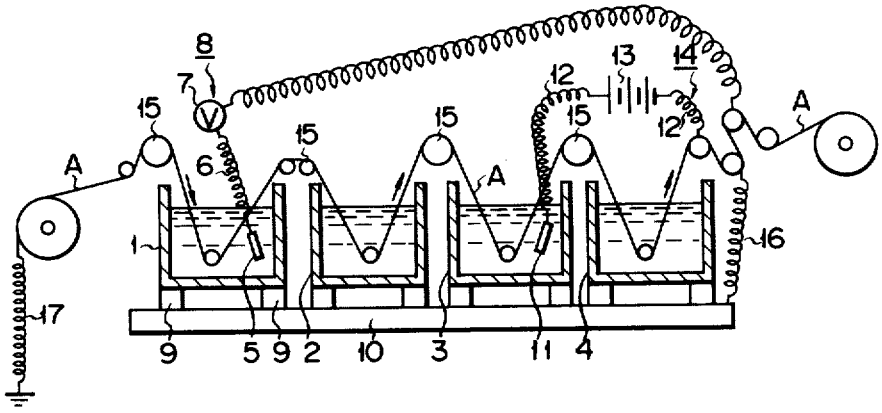
FIGS. 4 to 6 are schematic cross sectional views each showing a conventional apparatus for comparison with this invention.

An apparatus as shown in FIG. 4 was used for continuously treating a stainless steel strip. It is important to note that, in the apparatus of FIG. 4, the strip included in the potential difference-measuring circuit 8 is also included in the current conducting means 14.

During the treatment, the indication of the potentiometer 7 was greatly vibrated over a range of several millivolts because of the influence given by the current flowing in the electrolytic system, making it difficult to control the electric potential, with the result that the color display layer formed on the surface of the strip was quite non-uniform in color tone.

Figure 5:
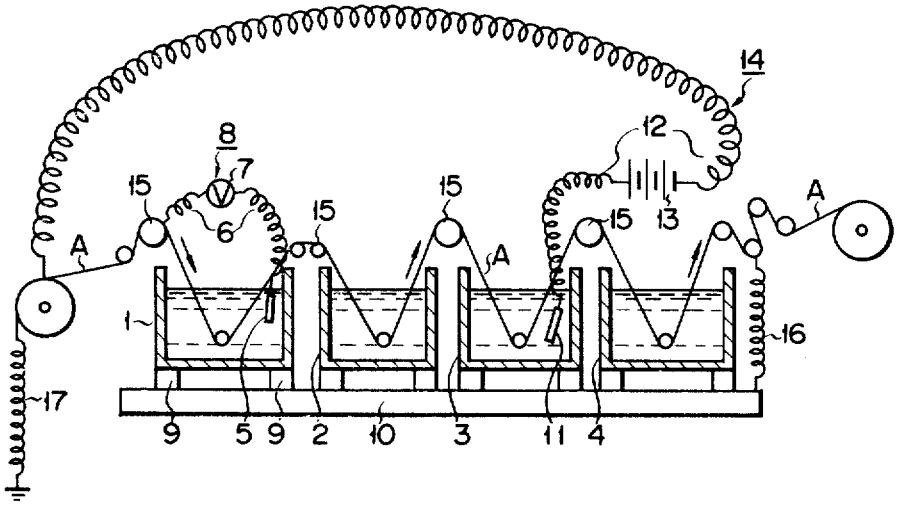

Likewise, an apparatus as shown in FIG. 5 was used for continuously treating a stainless steel strip. In this case, it was impossible to recognize the indication of the potentiometer 7 because of the influence given by the current flowing in the electrolytic system. Of course, it was substantially impossible to control the color tone of the color display layer formed on the strip.

Figure 6:
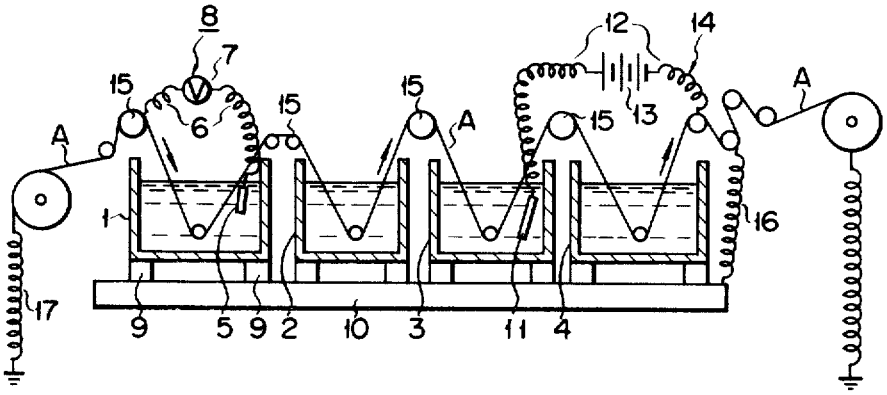

Further, an apparatus as shown in FIG. 6 was used for continuously treating a stainless steel strip. As apparent from the drawing, the take-up roll as well as the feed roll was electrically connected to the ground in the apparatus used. In this case, the indication of the potentiometer 7 was vibrated over a range of several millivolts because of the influence of the current flowing in the electrolytic system, with the result that the color display layer formed on the surface of the strip was quite non-uniform.

It is important to note that, in the present invention, the stainless steel strip included in the circuit for measuring the natural potential is electrically separated from the current conducting means. Thus, the natural potential-measuring circuit is not influenced by the current conducting means, with the result that the thickness of the oxide film formed on the surface of the strip can be controlled stably. It follows that the method and apparatus of this invention permit continuously treating a long stainless steel strip so as to form a color display layer of a uniform color tone on the entire surface of the strip.

As described above in detail, this invention is based on the finding that the thickness (or color tone) of a color display layer is strongly related to the potential difference between the stainless steel strip immersed in the oxidizing solution and the reference electrode in the process of continuously forming a color display layer on the surface of a stainless steel strip. Specifically, the particular relationship between the thickness and the potential difference mentioned above is utilized for controlling the immersion time of the stainless steel strip in the oxidizing solution. This renders it possible to control the immersion time accurately and to form a color display layer of uniform color tone. In addition, the immersion time can be controlled automatically.

In the process described above, a mixture of sulfuric acid and chromic acid used as the oxidizing solution. However, it is possible to use a different oxidizing solution in the method of this invention.

What we claim is:

1. A method of continuously forming a color display layer on the surface of a stainless steel strip by immersing the strip in an oxidizing solution comprising:

tentatively immersing a stainless steel strip continuously in an oxidizing solution in a tank for forming a color display layer on the surface of strip which is electrically insulated from the tank, thereby allowing to generate an electrical potential difference between the strip and the tank, and measuring first the relationship between the thickness or color tone of the color display layer and the potential difference between strip immersed in the oxidizing solution and a reference electrode; and continuously immersing the same kind of stainless steel strip in said oxidizing solution for forming a color display layer on the surface of said strip, the difference in thickness between the actually formed color display layer and a desired color display layer being converted to the difference in potential difference on the basis of the relationship measured first, and the immersion time of strip in the oxidizing solution being controlled on the basis of said difference in potential difference.

2. The method according to claim 1, wherein the oxidizing solution consists of 450~800 g/l of sulfuric acid and 50~350 g/l of chromic acid or bichromate.

3. The method according to claim 2, wherein the oxidizing solution is maintained at 70° to 120° C.

4. The method according to any one of claims 1 to 3, wherein either one of the stainless steel strip and the tank containing the oxidizing solution is insulated from the ground.

5. The method according to claim 1, wherein the stainless steel strip is further introduced into a hardening solution after being rinsed, and a power source is provided between the strip and an electrode immersed in the hardening solution thereby providing an electrical circuit which is substantially electrically separated from the electrical circuit in the oxidizing solution for measuring the potential difference.

* * * * *